United States Patent [19]

Ingalls

[11] Patent Number: 4,955,616

[45] Date of Patent: Sep. 11, 1990

[54] BOARD GAME

[76] Inventor: David E. Ingalls, 113 Tara Court Apt. D, Shepherd, Mich. 48883

[21] Appl. No.: 411,693

[22] Filed: Sep. 25, 1989

[51] Int. Cl.[5] ..... A63F 3/00

[52] U.S. Cl. ..... 273/249; 273/240

[58] Field of Search ..... 273/240, 242, 243, 248, 273/249, 257, 279

[56] References Cited

U.S. PATENT DOCUMENTS

| | | | |
|---|---|---|---|
| 3,371,931 | 3/1968 | Saunders | 273/249 |
| 3,858,885 | 1/1975 | Adcock | 273/243 |
| 4,216,971 | 8/1980 | Lyke | 273/243 |
| 4,273,337 | 6/1981 | Carrera et al. . | |
| 4,279,422 | 7/1981 | Shaw | 273/243 |
| 4,368,889 | 1/1983 | Reker, Jr. | 273/243 |
| 4,416,454 | 11/1983 | Delamontagne . | |
| 4,706,960 | 11/1987 | Nowacki | 273/257 |
| 4,718,675 | 1/1988 | Rosenberg et al. . | |

*Primary Examiner*—William H. Grieb
*Assistant Examiner*—William E. Stoll
*Attorney, Agent, or Firm*—Jerry T. Kearns

[57] ABSTRACT

A board game simulates educational, family, business, political and financial events and activities associated with life. The objective of the game is to maneuver a game marker through various movement paths in accordance with the throw of a numbered die to achieve a predetermined educational level and a predetermined financial account balance prior to reaching a finish or early retirement zone.

3 Claims, 3 Drawing Sheets

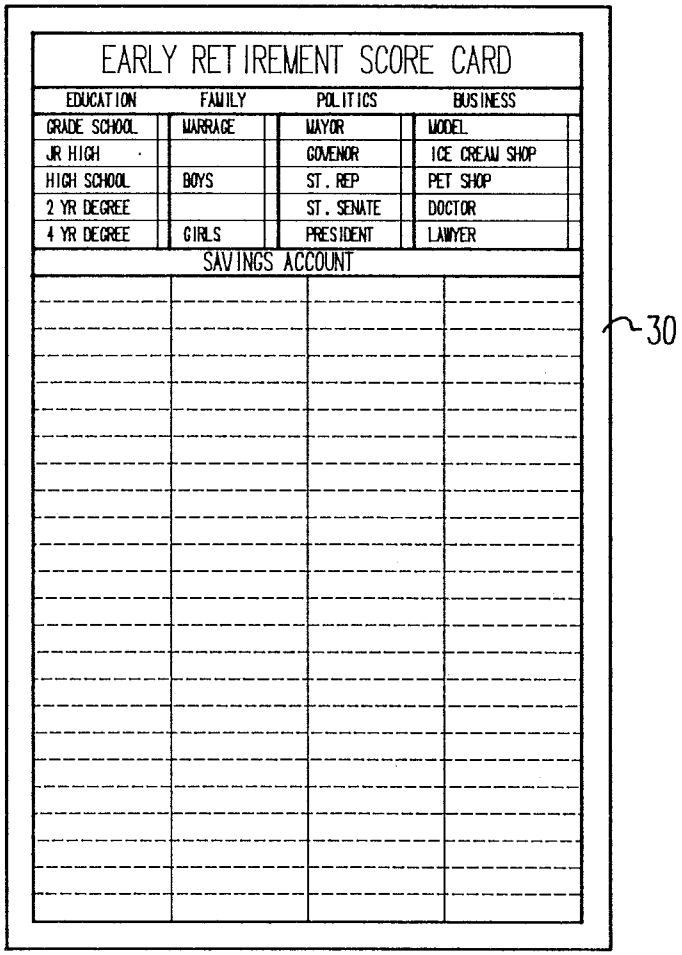
Fig. 5
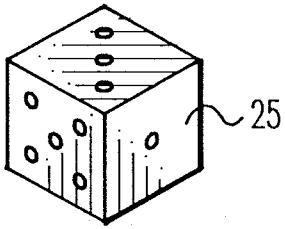
Fig. 2
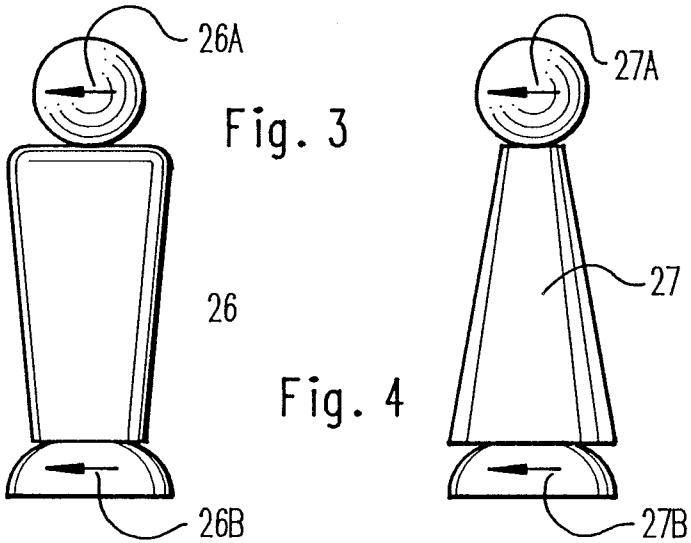
Fig. 3
Fig. 4

BOARD GAME

BACKGROUND OF THE INVENTION

1. Field of the Invention

The present invention relates to board games, and more particularly pertains to a new and improved board game which simulates various events and financial transactions associated with an individual's progress through life.

2. Description of the Prior Art

Various types of board games are known in the prior art. A typical example of such a board game is to be found in U.S. Pat. No. 4,273,337, which issued to M. Carrera et al on June 16, 1981. This patent discloses a board game intended to facilitate communication between parents and children regarding facts and attitudes in the area of human sexuality. The game utilizes a rectangular game board having a rectangular perimeter movement path formed by a series of sequential spaces. U.S. Pat. No. 4,279,422, which issued to M. Shaw on July 21, 1981, discloses a board game which simulates attending college. The game includes a game board upon which two separate paths of play are defined. One path of play is a college path which represents various academic and financial occurrences which befall the student-player. The other path defines a financial path which represents various financial occurrences which befall the player while working and not attending college. U.S. Pat. No. 4,368,889, which issued to L. Reker Jr. on Jan. 18, 1983, discloses a board game for simulating school experience which includes a rectangular game board having an outer peripheral path formed from a plurality of inner winding paths which may be entered and exited. U.S. Pat. No. 4,416,454, which issued to R. Delamontagne on Nov. 22, 1983, discloses a management teaching game which simulates a retail store environment in which a player must pay his opponent a certain amount of money determined by the number of questions the opponent has correctly answered in a given category corresponding to a given player position. U.S. Pat. No. 4,718,675, which issued to A. Rosenberg et al on Jan. 12, 1988, discloses a diet game in which the object of each player is to gain the least amount of weight. Each player is given a menu containing six pages of daily activities, each activity having twenty-four choices. These choices have a listing of foods and or activities and the associated calorie loss or gain.

While the above mentioned devices are directed to board games, none of these devices disclose a board game utilizing a game board having eight independent movement paths formed by a series of sequential spaces, with each space bearing indicia representing events and financial transactions associated with education, student summer activities, family life, business activities, political activities, financial activities, vacation activities and retirement activities. Inasmuch as the art is relatively crowded with respect to these various types of board games, it can be appreciated that there is a continuing need for and interest in improvements to such board games, and in this respect, the present invention addresses this need and interest.

SUMMARY OF THE INVENTION

In view of the foregoing disadvantages inherent in the known types of board games now present in the prior art, the present invention provides an improved board game. As such, the general purpose of the present invention, which will be described subsequently in greater detail, is to provide a new and improved board game which has all the advantages of the prior art board games and none of the disadvantages.

To attain this, a representative embodiment of the concepts of the present invention is illustrated in the drawings and makes use of a board game which simulates educational, family, business, political and financial events and activities associated with life. The objective of the game is to maneuver a game marker through various movement paths in accordance with the throw of a numbered die to achieve a predetermined educational level and a predetermined financial account balance prior to reaching a finish or early retirement zone.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game which has all the advantages of the prior art board games and none of the disadvantages.

It is another object of the present invention to provide a new and improved board game which may be easily and efficiently manufactured and marketed.

It is a further object of the present invention to provide a new and improved board game which is of a durable and reliable construction.

An even further object of the present invention is to provide a new and improved board game which is susceptible of a low cost of manufacture with regard to both materials and labor, and which accordingly is then susceptible of low prices of sale to the consuming public, thereby making such board game economically available to the buying public.

Still yet another object of the present invention is to provide a new and improved board game which provides in the apparatuses and methods of the prior art some of the advantages thereof, while simultaneously overcoming some of the disadvantages normally associated therewith.

Still another object of the present invention is to provide a new and improved board game which utilizes a board game format to simulate various activities and financial transactions associated with an individual's path through life.

Yet another object of the present invention is to provide a new and improved board game which utilizes a game board having a plurality of interconnected movement paths which allow a player a choice of selected game marker movement.

Even still another object of the present invention is to provide an entertaining and educational board game related to events and financial transactions associated with various education, family, business and political aspects of life.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective view illustrating a single numbered die for use with the game of the present invention.

FIG. 3 is a side elevational view illustrating a first game marker for movement about the game board of the present invention.

FIG. 4 is a side elevational view illustrating an alternative form of game marker.

FIG. 5 illustrates an individual score sheet utilized in the play of the game of the present invention.

DESCRIPTION OF THE PREFERRED EMBODIMENT

Figure 1:
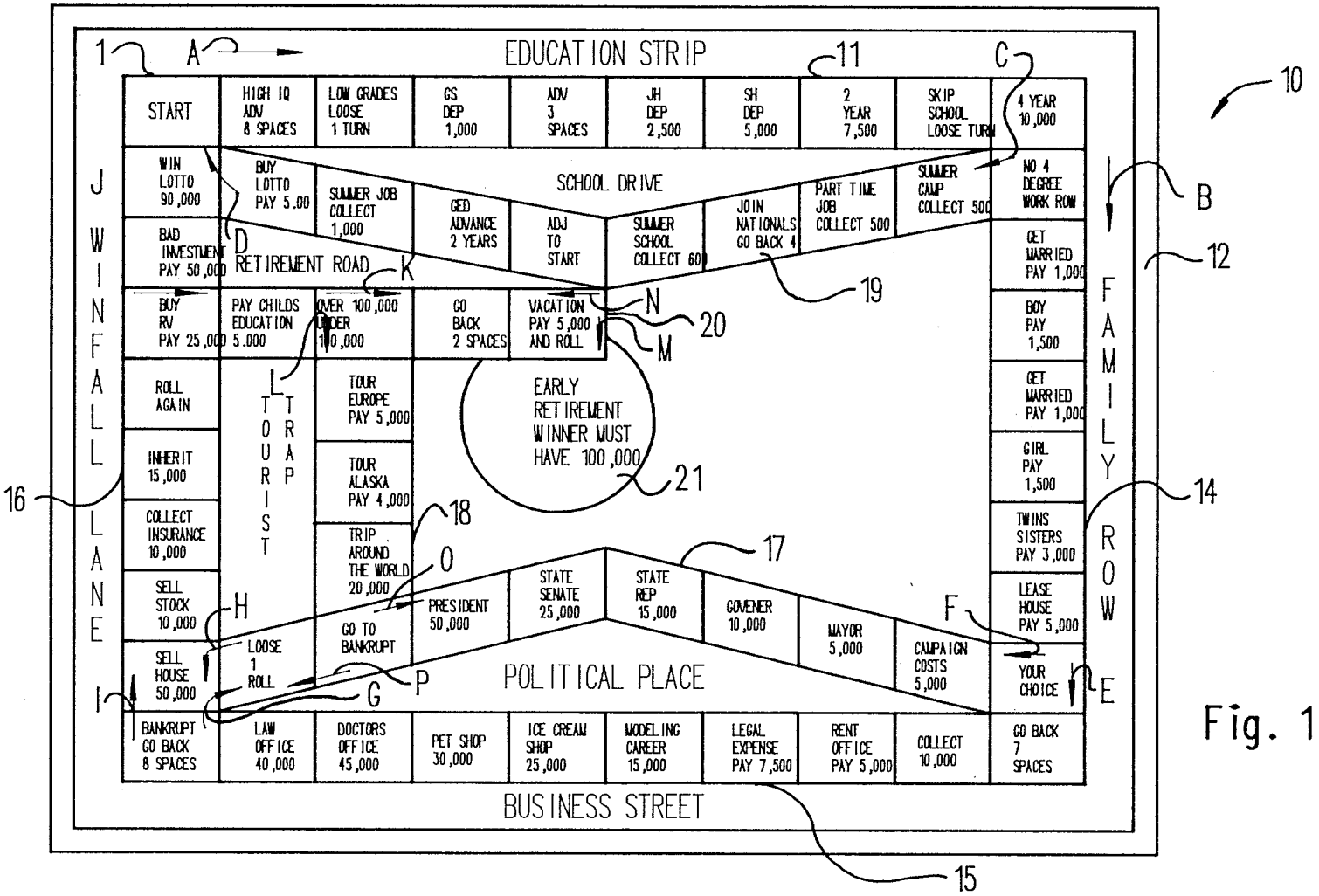
FIG. 1 illustrates the game board of the game of the present invention.

With reference now to the drawings, and in particular to FIG. 1 thereof, a new and improved board game embodying the principles and concepts of the present invention and generally designated by the reference numeral 10 will be described.

More specifically, it will be noted that the first embodiment 10 of the invention includes a rectangular game board 12 upon which a plurality of movement paths are formed by sequential interconnected spaces. A first movement path 11 extends along a first side edge of the game board 12 and is formed by a plurality of sequential spaces, each bearing indicia designating events and financial transactions associated with the attainment of education. A second movement path 14 extends along a second side edge of the game board 12 and is formed by a plurality of sequential spaces each bearing indicia designating events and financial transactions associated with family life. A third movement path 15 extends along a third side edge of the game board 12 and is formed by a plurality of sequential spaces each bearing indicia designating events and financial transactions associated with various business activities. A fourth movement path 16 extends along a fourth side edge of the game board 12 and is formed by a plurality of sequential spaces each bearing indicia designating events and financial transactions associated with various financial events. A start space 1 is formed at an intersection of the first movement path 11 and the fourth movement path 16. A fifth movement path 19 extends between the second 14 and fourth 16 movement path and is formed by a plurality of sequential spaces each bearing indicia designating events and financial transactions associated with student summer activities. A sixth movement path 17 extends between the second 12 and fourth 16 movement paths and is formed by a plurality of sequential spaces each bearing indicia designating events and financial transactions associated with political activities. A central finish zone 21 is formed on the game board 12. A seventh movement path 20 extends between the fourth movement path 16 and the finish zone 21, and is formed by a plurality of sequential spaces each bearing indicia designating events and financial transactions associated with various retirement activities. An eighth movement path 18 extends between the sixth 17 and seventh 20 movement path and is formed by a plurality of sequential spaces each bearing indicia designating events and financial transactions associated with various vacation activities.

FIG. 2 illustrates a single conventionally numbered die 25 which is utilized in the play of the game.

FIG. 3 illustrates a first form of game marker 26 for movement about the game board. The game marker 26 is configured to represent a male game player and may be provided in a variety of different colors to distinguish between players. Alternatively, a variety of different shapes of game markers may be provided. Each marker 26 has arrows 26A and 26B to determine direction of travel.

FIG. 4 illustrates a second form of game marker 27, formed to designate a female player. Alternatively, a variety of various different shapes of game markers, formed in a variety of different colors may be utilized to distinguish between game players. Each marker 27 has arrows 27A and 27B to determine direction of travel.

FIG. 5 illustrates a score sheet 30 utilized to keep track of various events achieved by a particular player, and having a savings account record area to maintain a tabulation of a player's financial status.

Figure 6:
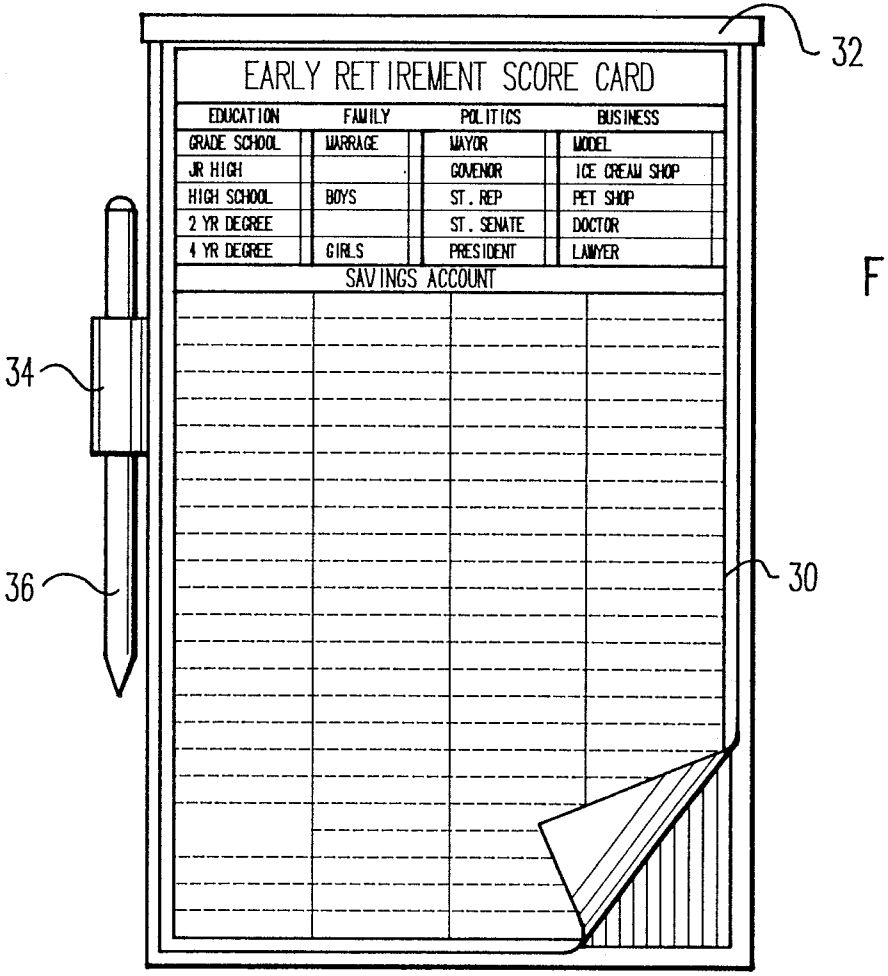
FIG. 6 illustrates a pad and holder which may be utilized to provide a plurality of sequentially usable score sheets.

FIG. 6 illustrates a pad 32 of sequentially usable score sheets 30 in association with a loop type holder 34 for a writing implement 36.

With reference now to FIGS. 1 through 5, the manner of play of the game of the present invention will now be described. A group of players selects an initial player by rolling the die 25 shown in FIG. 2. The initial player then places their respective game marker, 26 or 27 as shown in FIGS. 3 and 4, at the start space 1. The die 25 is then rolled to determine the number of spaces along the first movement path 11 that the player's game marker will be advanced. The space upon which the player's game marker lands will bear indicia associated with a particular educational activity. The player then records the educational event in the educational column on the score sheet 30. It should be noted that the educational levels of grade school, junior high, high school, two year college degree, and four year college degree can be attained in any sequence prior to tabulation on the score sheet 30. Thus, an individual may obtain a high school degree prior to completion of a grade school diploma. Thus, if a player rolls a "one" on die 25 from the start space he advances to the 4 year degree and may move down the path 14 on his next roll. Thus, the player initially advances in the direction of the arrow A along the movement path 11. Upon reaching the "NO 4 DEGREE WORK ROW" space, a player must continue along the movement path 19 as indicated by arrow C unless a four year college degree has been achieved. If the player has previously completed a four year degree, the player may advance in the direction of arrow B along the movement path 14, which is formed by sequential spaces bearing indicia representing various family activities and associated financial transactions. Play continues in sequential fashion, with each player rolling the die 25 to determine movement of their respective game marker about the various movement paths on the game board 12. When an individual reaches the end of the student summer activity movement path 19, they must move in the direction of arrow D, back to the start space 1 and again along the educational movement path 11. Each player is stuck on the loop until attainment of a four year college degree. It should be noted that two separate two year degrees are equivalent to a four year degree. Upon reaching the "YOUR CHOICE" space, a player has the option of continuing along either the business activity movement path 15, or the political activity movement path 17, as respectively designated by arrows E and F. If a player has elected movement along the business activity path 15, a player must move in a reverse direction along the political activity path 17 as indicated by arrow G, unless the player has achieved a financial savings account balance of $100,000. If a $100,000 has been achieved, the player may advance as indicated by arrow I along the financial activity or windfall movement path 16 The player may then advance as indicated by arrow J along the retirement activity movement path 20 in an attempt to reach the central "EARLY RETIREMENT" finish zone 21. Any player travelling along the movement path 20 must roll the exact total on the die 25 to reach the finish space 21. If an individual rolls a greater number, their game marker remains on the original square and the die is passed to the next sequential player. Upon reaching the "VACATION PAY $5000 AND ROLL" space, a player must remain on this space until a one total is rolled on the die 25. A player must deduct $5000 from their savings account total for each roll of the die, and if they successfully roll a one die total while having a savings account balance of greater than $100,000, they may advance to the finish space 21 as indicated by arrow M. If the player's savings account balance is reduced below $100,000 prior to rolling the exact die total to reach the finish space 21, the player must move in the reverse direction as indicated by arrow N along the movement path 20 It should be noted that any player reaching the "OVER $100,000, UNDER $100,000" space may advance toward the finish space 21 as indicated by arrow K if their savings account balance is greater than $100,000, or must travel along the vacation path 18 as indicated by arrow L if their savings account total is less than $100,000. If a player has chosen to move in the direction of arrow F along the political activity movement path 17, they must continue movement in the reverse direction along the business activity movement path 15 as indicated by arrow H unless they have reached an account balance of greater than $100,000, whereupon they may advance as indicated by arrow I along the financial activity or windfall path 16. Any player travelling along the vacation activity movement path 18 as indicated by arrow L has the option of travelling in either direction along the political activity movement path 17, as indicated by arrows 0 and P. As may now be understood, the game board of the game of the present invention includes a first restricted loop formed by movement paths 11 and 19 upon which a player is constrained until a predetermined educational level has been achieved. After completion of this educational level, the player may advance along the family activity movement path 14 to a second movement loop formed by the business activity path 15 and the political activity path 17. A player is restrained to movement in a loop about the paths 15 and 17 in a circular fashion, until a predetermined savings account balance in excess of $100,000 has been achieved. Whereupon the player may advance along the financial activity or windfall movement path 16 toward game completion. In addition to the previously described manner of play, the following additional rules should be noted. When any player achieves a four year degree, they are awarded $20,000 to their savings account balance. Any player who lands on the "GET MARRIED" space on the family activity path 14 may be subsequently allowed to have children and tabulate these events on their score sheet 30. Any player who has not been married may not have children, but is still assessed the hospital fees when the designated child bearing spaces are landed upon. Any player who reduces their account balance to zero immediately moves their game piece to the , corner space designated by the indicia "BANKRUPT". Additionally, any player landing on the "BANKRUPT" must immediately reduce their savings account balance to zero.

As may now be understood, the present invention provides an amusing race track format board game which additionally teaches individuals the importance of education, about family life, about financial transactions and activities, about political activities, about business activities, and additionally teaches basic addition and subtraction. Because of the wide variety of different movement paths, each game will be different providing a substantial degree of variety. Because only one die is utilized, the play of the game will be relatively rapid and may be completed in between fifteen and thirty minutes.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing a board game, comprising the steps of:

providing:

a rectangular game board, said game board having indicia designating a plurality of interconnected movement paths, each of said movement paths formed by a plurality of interconnected sequential spaces;

a first movement path extending along a first side edge of said game board and formed by a plurality of spaces each bearing indicia designating events and financial transactions associated with attainment of education;

a second movement path extending along a second side edge of said game board and formed by a plurality of spaces each bearing indicia designating events and financial transactions associated with family life;

a third movement path extending along a third side edge of said game board and formed by a plurality of spaces each bearing indicia designating events and financial transactions associated with various business activities;

a fourth movement path extending along a fourth side edge of said game board and formed by a plurality of spaces each bearing indicia designating events and financial transactions associated with various financial events;

a start space at an intersection of said first and fourth movement path;

a fifth movement path extending between said second and fourth movement paths and formed by a plurality of spaces each bearing indicia designating events and financial transactions associated with student summer activities;

a sixth movement path extending between said second and fourth movement paths and formed by a plurality of spaces each bearing indicia designating events and financial transactions associated with political activities;

a central finish zone on said game board;

a seventh movement path extending between said fourth movement path and said finish zone and formed by a plurality of spaces each bearing indicia designating events and financial transactions associated with various retirement activities;

an eighth movement path extending between said sixth and seventh movement paths and formed by a plurality of sequential spaces each bearing indicia designating events and financial transactions associated with various vacation activities;

one numbered die;

a plurality of game markers for movement around said movement paths;

a plurality of score sheets, each of said score sheets having indicia for tabulating educational, family, political, business and financial activities of a game player associated with movement of a game marker around said movement paths;

selecting an initial player from a plurality of players;

said initial player rolling said die and moving a respective one of said game markers along said first movement path toward said second movement path in accordance with a number of spaces indicated by said die;

play continuing in sequential fashion, with each player recording events and financial transactions on a respective score sheet in accordance with indicia designated on movement path spaces;

each player's game marker restricted to movement on said first and fifth movement paths until a predetermined educational event has been achieved;

each player's game marker allowed to move along said second movement path upon achieving said predetermined educational event;

each player optionally moving a respective game marker along said third or said sixth movement paths upon reaching an end of said second movement path;

each player's game marker restricted from movement on said fourth movement path until a predetermined financial total has been achieved;

each player's game marker restricted for movement to said finish zone until a predetermined financial total has been achieved; and continuing play in sequential fashion until a player achieves said predetermined financial total and moves a respective game marker to said finish zone as indicated by an exact movement total on said die.

2. A method of playing a board game, comprising the steps of:

providing a rectangular game board, said game board having indicia designating a plurality of interconnected movement paths, each of said movement paths formed by a plurality of interconnected sequential spaces;

a first movement path extending along a first side edge of said game board and formed by a plurality of spaces each bearing indicia designating events and financial transactions associated with attainment of education;

a second movement path extending along a second side edge of said game board and formed by a plurality of spaces each bearing indicia designating events and financial transactions associated with family life;

a third movement path extending along a third side edge of said game board and formed by a plurality of spaces each bearing indicia designating events and financial transactions associated with various business activities;

a fourth movement path extending along a fourth side edge of said game board and formed by a plurality of spaces each bearing indicia designating events and financial transactions associated with various financial events;

a start space at an intersection of said first and fourth movement path;

a fifth movement path extending between said second and fourth movement paths and formed by a plurality of spaces each bearing indicia designating events and financial transactions associated with student summer activities;

a sixth movement path extending between said second and fourth movement paths and formed by a plurality of spaces each bearing indicia designating events and financial transactions associated with political activities;

a central finish zone on said game board;

a seventh movement path extending between said fourth movement path and said finish zone and formed by a plurality of spaces each bearing indicia designating events and financial transactions associated with various retirement activities;

one numbered die;

a plurality of game markers for movement around said movement paths;

a plurality of score sheets, each of said score sheets having indicia for tabulating educational, family, political, business and financial activities of a game player associated with movement of a game marker around said movement paths;

selecting an initial player from a plurality of players;

said initial player rolling said die and moving a respective one of said game markers along said first movement path toward said second movement path in accordance with a number of spaces indicated by said die;

play continuing in sequential fashion, with each player recording events and financial transactions on a respective score sheet in accordance with indicia designated on movement path spaces;

each player's game marker restricted to movement on said first and fifth movement paths until a predetermined educational event has been achieved;

each player's game marker allowed to move along said second movement path upon achieving said predetermined educational event;

each player optionally moving a respective game marker along said third or said sixth movement paths upon reaching an end of said second movement path;

each player's game marker restricted from movement on said fourth movement path until a predetermined financial total has been achieved;

each player's game marker restricted for movement to said finish zone until a predetermined financial total has been achieved; and continuing play in sequential fashion until a player achieves said predetermined financial total and moves a respective game marker to said finish zone as indicated by an exact movement total on said die.

3. The method of playing a board game according to claim 2, further comprising the steps of:

providing:

an eighth movement path extending between and intersecting said sixth and seventh movement paths and formed by a plurality of sequential spaces each bearing indicia designating events and financial transactions associated with various vacation activities; and each player restricted from movement along said seventh movement path past the intersection with said eighth movement path until a predetermined financial total has been achieved.

* * * * *